United States Patent [19]

Matumoto et al.

[11] 4,103,649

[45] Aug. 1, 1978

[54] METHOD AND SYSTEM FOR CONTROLLING THE MIXTURE AIR-TO-FUEL RATIO

[75] Inventors: Eizi Matumoto; Hideaki Norimatsu, both of Kariya, Japan

[73] Assignee: Nippondenso Co., Ltd., Kariya, Japan

[21] Appl. No.: 692,049

[22] Filed: Jun. 2, 1976

[30] Foreign Application Priority Data

Jun. 17, 1975 [JP] Japan ..... 50-73970

[51] Int. Cl.[2] ..... F02B 3/00

[52] U.S. Cl. ..... 123/32 EE; 123/119 EC

[58] Field of Search ..... 123/32 EA, 32 EE, 119 EC; 60/276, 285; 340/52 R

[56] References Cited

U.S. PATENT DOCUMENTS 3,875,907 4/1975 Wessel et al. ..... 123/32 EE

*Primary Examiner*—Samuel Feinberg

*Attorney, Agent, or Firm*—Cushman, Darby & Cushman

[57] ABSTRACT

A closed loop air-to-fuel ratio control system having an oxygen responsive sensor and a feedback circuit is disclosed. The sensor is disposed in an exhaust passage to produce a voltage indicative of the oxygen concentration in the exhaust gas. This voltage is integrated in the feedback circuit to cause the mixture air-to-fuel ratio to be corrected in response thereto. During specific engine conditions such as engine idling and low temperature of the exhaust gas, the integration is stopped to thereby switch off the closed loop to an open loop. The engine, on this occasion, can be supplied with the air-fuel mixture of an arbitrary ratio irrespective of the oxygen concentration in the exhaust gas, resulting in the optimum air-to-fuel control well-matched to the engine conditions.

9 Claims, 3 Drawing Figures

METHOD AND SYSTEM FOR CONTROLLING THE MIXTURE AIR-TO-FUEL RATIO

BACKGROUND OF THE INVENTION

1. Field of the Invention

The present invention relates to an air-to-fuel ratio control system for an internal combustion engine, wherein a closed feedback loop for controlling the mixture ratio is switched off to an open loop during specific engine conditions.

2. Description of the Prior Art

A closed loop feedback control system for internal combustion engines has been highly appreciated from the point that the air-to-fuel ratio of the mixture to be supplied to the engine can be controlled to the stoichiometric ratio at which exhaust emissions therefrom becomes tolerable. It is a well-known matter, on the other hand, that the engine requires the air-fuel mixture other than the stoichiometric mixture upon specific engine conditions such as idling and that the oxygen responsive sensor is inoperative under the low ambient temperature. The closed loop feedback control, for this reason, must be switched off under these conditions.

SUMMARY OF THE INVENTION

It is, therefore, a primary object of the invention to switch off a closed loop feedback control system to an open loop control system under specific engine conditions.

It is another object of the invention to stop the integration operation of the feedback control system to thereby switch off the closed loop system.

It is a further object of the invention to stop the integration operation while the oxygen sensor is inoperative.

It is a still further object of the invention to stop the integration operation while a throttle valve is fully opened and closed.

It is a still further object of the invention to stop the integration operation while the engine is in at least one preselected conditions.

DETAILED DESCRIPTION OF THE PREFERRED EMBODIMENT

Figure 1:
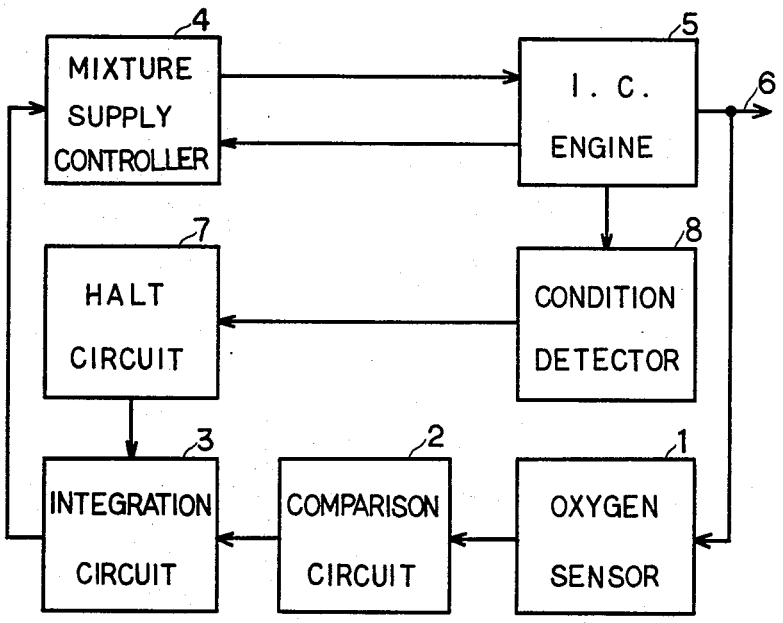
FIG. 1 is a block diagram illustrating an embodiment of this invention.

Referring to the embodiment shown in FIG. 1, an oxygen responsive sensor ($O_2$-sensor) 1 is provided in an exhaust passage 6 of an internal combustion engine 5. The engine 5 is provided with a mixture supply controller 4, which detects operating conditions of the engine 5 and in turn supplies air-fuel mixture thereto. The mixture supply controller 4 is constructed as a well-known fuel injection controller, in this embodiment, which determines the fuel injection duration in accordance with the engine conditions such as air amount sucked into the engine 5 and rotational speed thereof.

The $O_2$-sensor 1 is connected, via a comparison circuit 2, to an integration circuit 3 which is connected to the mixture supply controller 4 for correcting the mixture air-to-fuel ratio to the stoichiometric ratio in response to the sensor output voltage. A closed feedback loop comprising the oxygen sensor 1, the comparison circuit 2 and the integration circuit 3 is switched off from the controller 4 under preselected specific engine conditions. A condition detector 8 coupled to the engine 5 detects the preselected engine conditions and a halt circuit 7 halts the integration operation of the integration circuit 3 in response to a detection signal from the condition detector 8.

Figure 2:
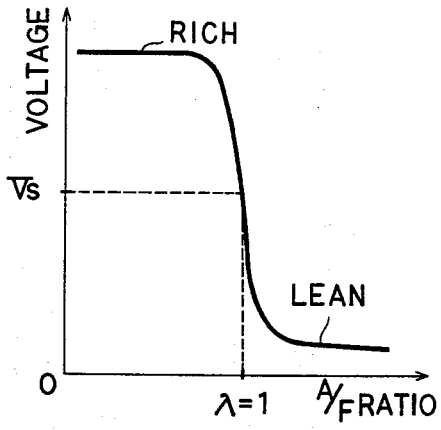
FIG. 2 is a graph showing an output voltage characteristics of an oxygen responsive sensor.

The output voltage characteristics of the $O_2$-sensor 1 is shown in FIG. 2, wherein the abscissa and the ordinate respectively represent the mixture air-to-fuel ratio and the output voltage. As can be seen from FIG. 2, the output voltage level of the $O_2$-sensor 1 is high and low for the lesser ratio (air number $\lambda<1$ or rich mixture) and the greater ratio ($\lambda>1$ or lean mixture), respectively, and it abruptly changes from one level to the other at the stoichiometric ratio ($\lambda=1$) above which oxygen is present in the exhaust gas.

Figure 3:
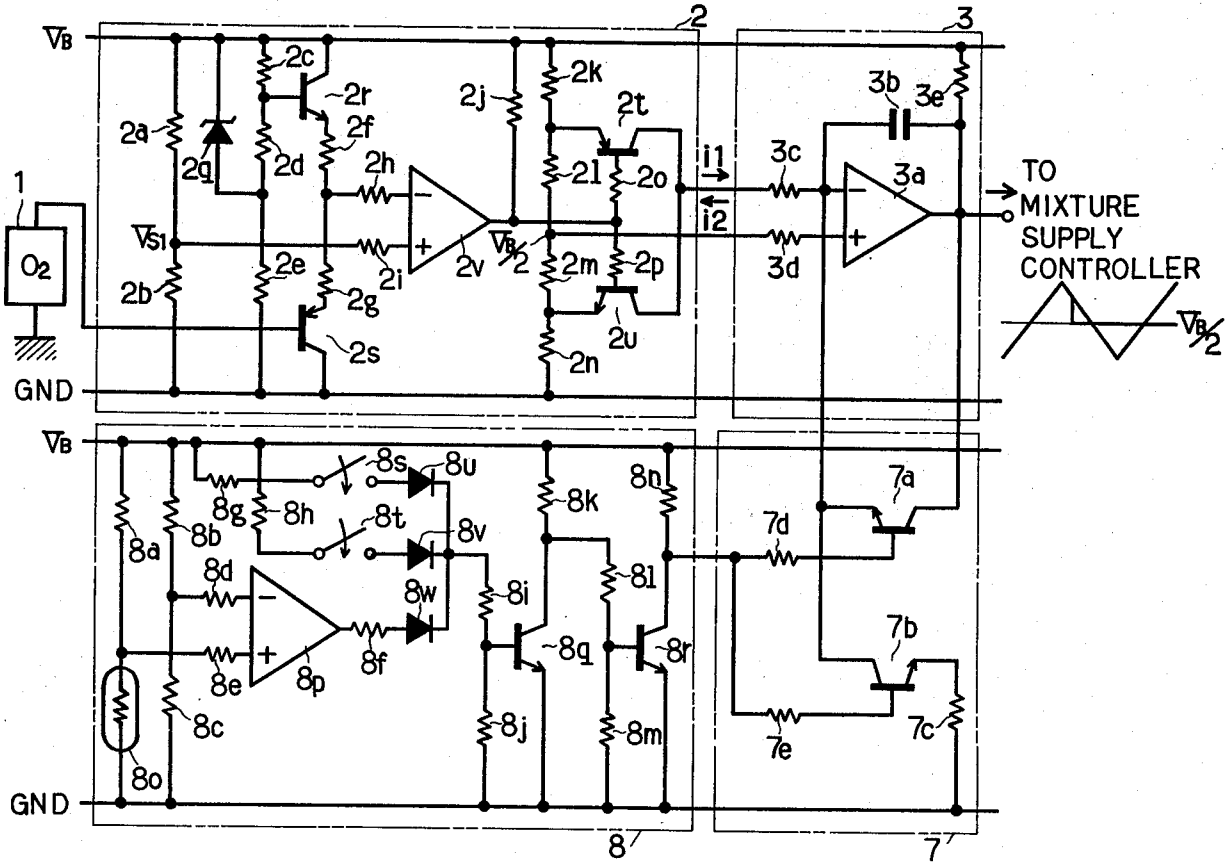
FIG. 3 is an electric wiring diagram of the feedback loop shown in FIG. 1.

In FIG. 3 showing a detail circuit construction of the feedback loop, $V_B$ and GND designate the voltage potential of a storage battery (not shown) and the ground potential, respectively. The comparison circuit 2 is constructed with resistors 2*a* to 2*p*, a zener diode 2*q*, transistors 2*r* to 2*u* and an operational amplifier 2*v*. The amplifier 2*v* receives the set voltage $V_{sl}$ divided by the resistors 2*a* and 2*b* at the positive terminal (+) via the resistor 2*i* and the voltage developing at the junction of the resistors 2*f* and 2*g* at the negative terminal (−) via the resistor 2*h*. The set voltage $V_{sl}$ is selected to be proportional to the sensor output voltage $V_s$ (FIG. 2) indicative of the stoichiometric ratio of the air-fuel mixture. The transistor 2*s* connected to the resistor 2*g* receives at the base thereof the output voltage of the $O_2$-sensor 1, whereas the transistor 2*r* connected to the resistor 2*f* receives at the base thereof a constant voltage regulated by the zener diode 2*q* and the resistors 2*c*, 2*d* and 2*e*.

Receiving the low level output voltage indicative of the lean mixture from the $O_2$-sensor 1, the transistor 2*s* is rendered conductive to provide the negative terminal of the amplifier 2*v* with a voltage lower than the set voltage $V_{sl}$. Receiving the high level output voltage indicative of the rich mixture from the $O_2$-sensor 1, the transistor 2*s* is rendered nonconductive to provide with a voltage higher than the set voltage $V_{sl}$. The amplifier 2*v*, comparing the two input voltages, produces a high level and a low level comparison-resultant voltages when the negative terminal voltage is lower and higher than the positive terminal voltage $V_{sl}$, respectively.

The comparison-resultant voltage is applied to the bases of the transistors 2*t* and 2*u*, the collectors thereof being connected to each other, through the respective resistors 20 and 2*p* to control the on-off condition thereof. The resistors 2*k*, 2*l*, 2*m* and 2*n* are connected in series across the $V_B$ line and the GND line and the emitters of the transistors 2*t* and 2*u* are connected to the junction of the resistors 2*k* and 2*l* and to the junction of the resistors 2*m* and 2*n*, respectively.

The transistor 2*t* becomes conductive in response to the low level comparison-resultant voltage and an electric current *i*1 flows therethrough to the integration circuit 3, whereas the transistor 2*u* becomes conductive in response to the high level comparison-resultant voltage and an electric current *i*2 flows therethrough from the integration circuit 3.

The integration circuit 3 is constructed with an operational amplifier 3*a*, a capacitor 3*b* and resistors 3*c*, 3*d* and 3*e*. The negative terminal (−) and the positive terminal (+) of the amplifier 3*a* are connected to the collectors of the transistors 2*t* and 2*u* via the resistor 3*c* and to the junction of the resistors 2*l* and 2*m* to be provided with the set voltage $^{V}B/_{2}$ through the resistor 3*d*, respectively. Connected between the input terminal (−) and the output terminal of the amplifier 3*d* is the capacitor 3*b* for integrating the currents *i*1 and *i*2. The integration circuit 3 produces an integration-resultant voltage which increases while the current *i*2 is integrated and decreases while the current *i*1 is integrated.

The integration-resultant voltage repetitively becomes higher and lower than the set voltage $^{V}B/_{2}$ provided that the engine 5 is supplied with the air-fuel mixture of the stoichiometric ratio. Correcting the mixture air-to-fuel ratio in accordance with the integration-resultant voltage, more particularly increasing and decreasing the fuel amount while the voltage is higher and lower than the set voltage $^{V}B/_{2}$ respectively, the air-to-fuel ratio of the mixure supplied from the mixture supply controller can be controlled to the stoichiometric ratio.

The integration operation of the integration circuit 3 is controlled by the halt circuit 7 and the condition detector 8. The halt circuit 7 is constructed with transistors 7*a* and 7*b* and resistors 7*c*, 7*d* and 7*e*. The condition detector 8 is constructed with resistors 8*a* to 8*n*, a thermally-sensitive resistor 80, an operational amplifier 8*p*, transistors 8*q* and 8*r*, on-off switches 8*s* and 8*t* and diodes 8*u*, 8*v* and 8*w*.

The thermally-sensitive resistor 80 having a negative temperature coefficient is positioned in the exhaust passage to detect the ambient exhaust temperature of the $O_2$-sensor 1 which is inoperative, as well known, under the temperature 450°∼600° C. A voltage indicative of the ambient temperature and developing at the junction of the resistors 8*a* and 8*o* and a set voltage determined by the resistors 8*b* and 8*c* to be corresponding to the ambient temperature over which the $O_2$-sensor 1 becomes operative are applied to the amplifier 8*p*. Inasmuch as the former voltage decreases as the ambient temperature rises, the amplifier 8*p* produces a high level voltage only while the $O_2$-sensor is in the inoperative condition.

The on-off switches 8*s* and 8*t* are connected to the $V_B$ line via the respective resistors 8*g* and 8*h*. The switch 8*s* closes only while a throttle valve (not shown) is fully closed due to engine idling and engine deceleration, whereas the switch 8*t* closes only while the throttle valve is fully opened due to engine acceleration.

The three diodes 8*u*, 8*v* and 8*w* constitute an OR logic gate which passes only the high level voltage to cause the transistor 8*q* conductive. The transistor 8*r*, as a result, is rendered nonconductive only while the exhaust temperature is low, the throttle valve is fully closed or the throttle valve is fully opened.

The transistors 7*a* and 7*b* of the halt circuit 7, connected to the transistor 8*r* of the condition detector 8 to be responsive thereto, is rendered conductive upon receipt of the high level voltage applied through the resistors 7*d* and 7*e*. The transistors 7*a* and 7*b*, in the conduction state, causes the capacitor 3*b* of the integration circuit 3 to be discharged therethrough and halts the above-described integration operation. The integration-resultant voltage to be applied to the mixture supply controller 4 is eventually maintained to the set voltage $^{V}B/_{2}$ with which correction of the air-to-fuel ratio is not made any longer.

Thus switching off the closed feedback loop to the open loop, erroneous feedback control resulting from inoperativeness of the $O_2$-sensor 1 can be prevented until the $O_2$-sensor 1 becomes operative and the engine 5 can be supplied with the air-fuel mixture of the ratio other than the stoichiometric ratio during the engine acceleration and idling. It should be understood herein that halting the integration operation in the feedback loop can be made responsive to other engine conditions such as engine coolant temperature and engine rotational speed without departing from the scope of this invention.

What we claim is:

1. An air-fuel mixture ratio control system for internal combustion engines comprising:

an oxygen responsive sensor, positioned in an exhaust passage of an engine, for producing a sensor signal indicative of the oxygen concentration threrein;

a comparison circuit, connected to said sensor, for producing a comparison signal in response to said sensor signal, said comparison signal having two constant signal levels indicative of the oxygen presence and the oxygen absence, respectively;

an integration circuit, connected to said comparison circuit and including an operational amplifier and a capacitor adapted to be charged and discharged in response to said comparison circuit, for producing an integration signal changing in the increasing and decreasing directions in response to said signal levels of said comparison signal;

a mixture supply controller, positioned in an intake passage and connected to said integration circuit, for supplying said engine with air-fuel mixture, the air-to-fuel ratio thereof being responsive to engine operating conditions and said integration signal;

a condition detector, coupled to said engine, for producing a detection signal indicative of at least one of full-opening and full-closing of a throttle valve and inoperativeness of said sensor; and an integration half circuit, connected between said condition detector and said integration circuit and including switching means connected across said capacitor, for short-circuiting said capacitor by said switching means in response to said detection signal to thereby halt the integration operation and cause said mixture air-to-fuel ratio to be irresponsive to said integration signal.

2. A control system as set forth in claim 1, wherein said condition detector includes:

first means for detecting the fully-closed position of said throttle valve, second means for detecting the fully-opened position of said throttle valve, third means for detecting the exhaust gas temperature, and OR logic means, input terminals thereof being connected to said first, second and third means and an output terminal thereof being connected to said switching means.

3. A system for controlling the mixture air-to-fuel ratio comprising:

sensor means positioned to be responsive to the exhaust gas of an engine for producing an output signal indicative of the air-to-fuel ratio of mixture supplied to said engine;

integrator means including an amplifier and a capacitor connected across said amplifier for producing an output signal by charging and discharging said capacitor in response to said output signal of said sensor means;

mixture control means adapted to control the air-to-fuel ratio of mixture for said engine in accordance with engine conditions and said output signal of said integrator means;

detector means adapted to produce an output signal indicative of a predetermined engine condition; and switch means connected across said capacitor of said integrator means to stop the operation of said intergrator means by short-circuiting said capacitor in response to said output signal of said detector means, whereby the air-to-fuel ratio of mixture for said engine is controlled irrespective of said output signal of said sensor means.

4. A system as set forth in claim 3, wherein said detector means includes a detection circuit for detecting the inoperative condition of said sensor means as said predetermined engine condition.

5. A system as set forth in claim 4, wherein said detection circuit includes:

a temperature responsive element positioned to detect the temperature of exhaust gas; and a comparator connected to compare the output value of said temperature responsive element with a threshold value over which said sensor means is kept in operative condition.

6. A system as set forth in claim 3, wherein said sensor means includes an oxygen responsive sensor for sensing the presence and the absence of oxygen in said exhaust gas.

7. A system as set forth in claim 3, wherein said switch means includes a semiconductor switching element adapted to be rendered conductive in response to said output signal of said detector means.

8. A method for controlling the air-to-fuel ratio of mixture comprising the steps of:

detecting the absence and presence of oxygen in the exhaust gas produced from an engine;

integrating the result of said oxygen detecting step with respect to time by an integration circuit having an operational amplifier and a capacitor connected to be charged and discharged;

detecting at least two predetermined operating conditions of said engine;

preventing said integration of said integration circuit in said integrating step by short-circuiting said capacitor while at least one of said two predetermined operating conditions is detected by said condition detecting step to thereby keep the integration output at a constant value irrespective of changes of the result of said oxygen detecting step; and controlling the air-to-fuel ratio of mixture supplied to said engine in accordance with said integration output which is different from said constant value.

9. An air-fuel mixture ratio control system for internal combustion engines comprising:

an oxygen responsive sensor, positioned in an exhaust passage of an engine, for producing a sensor signal indicative of the oxygen concentration therein;

a comparison circuit, connected to said sensor, for producing a comparison signal in response to said sensor signal, said comparison signal having two constant signal levels indicative of the oxygen presence and the oxygen absence, respectively;

an integration circuit, connected to said comparison circuit and including an operational amplifier and a capacitor adapted to be charged and discharged in response to said comparison circuit for producing an integration signal changing in the increasing and decreasing directions in response to said signal levels of said comparison signal;

a mixture supply controller, positioned in an intake passage and connected to said integration circuit, for supplying said engine with air-fuel mixture, the air-to-fuel ratio thereof being responsive to engine operating conditions and said integration signal;

a condition detector, coupled to said engine and separate from said oxygen responsive sensor for producing a detection signal indicative of full-opening and full-closing of a throttle valve, and inoperativeness of said sensor; and an integration halt circuit, connected between said condition detector and said integration circuit and including switching means connected across said capacitor, for short-circuiting said capacitor by said switching means in response to said detection signal to thereby halt the integration operation and cause said mixture air-to-fuel ratio to be irresponsive to said integration signal.

* * * * *